US011345522B2

(12) United States Patent
Freedman et al.

(10) Patent No.: US 11,345,522 B2
(45) Date of Patent: May 31, 2022

(54) PACKAGING SEALING SYSTEM AND A PACKAGING ASSEMBLY INCLUDING SUCH A SEALING SYSTEM

(71) Applicant: CSP Technologies, Inc., Auburn, AL (US)

(72) Inventors: Jonathan Freedman, Auburn, AL (US); Donald Lee Huber, Auburn, AL (US); Michael Bucholtz, Balston Spa, NY (US); Randall Christopher LeCroy, Opelika, AL (US)

(73) Assignee: CSP Technologies, Inc., Auburn, AL (US)

( * ) Notice: Subject to any disclaimer, the term of this patent is extended or adjusted under 35 U.S.C. 154(b) by 119 days.

(21) Appl. No.: 16/698,893

(22) Filed: Nov. 27, 2019

(65) Prior Publication Data

US 2020/0095027 A1 Mar. 26, 2020

Related U.S. Application Data

(63) Continuation of application No. 14/761,678, filed as application No. PCT/US2014/012425 on Jan. 22, 2014, now abandoned.
(Continued)

(51) Int. Cl.
*B65D 43/22* (2006.01)
*B65D 41/04* (2006.01)
(Continued)

(52) U.S. Cl.
CPC ..... *B65D 43/22* (2013.01); *B65D 41/005* (2013.01); *B65D 41/0428* (2013.01);
(Continued)

(58) Field of Classification Search
CPC ..... B65D 41/023; B65D 43/22; B65D 41/005
(Continued)

(56) References Cited

U.S. PATENT DOCUMENTS 2,125,788 A 8/1938 Johnson
3,747,792 A 7/1973 Anthony
(Continued)

FOREIGN PATENT DOCUMENTS

CN 202670414 U 1/2013
DE 1051723 B 2/1959
JP 4636652 B2 2/2011

OTHER PUBLICATIONS

International Search Report for International Application No. PCT/US2014/012425, dated Jun. 23, 2014.

*Primary Examiner* — Jeffrey R Allen
(74) *Attorney, Agent, or Firm* — Mark T. Vogelbacker; Eckert Seamans Cherin & Mellott, LLC

(57) ABSTRACT

A packaging assembly includes a container body defining an interior for housing a product and an opening leading to the interior. The assembly further includes a cap that moves with respect to the container body to move the assembly between a closed position in which the cap covers the opening, and an opened position in which the opening is exposed. A first seal (40) is defined between the container body and the cap. The first seal includes a protrusion (42) formed on one of the container body about the opening or the cap, and a groove (44) formed on the other of the container body about the opening or the cap. The protrusion is received by the groove when the assembly is in the closed position, such that contact is maintained in a sealing relationship around the opening between the groove and the protrusion.

18 Claims, 13 Drawing Sheets

Related U.S. Application Data

(60) Provisional application No. 61/755,555, filed on Jan. 23, 2013.

(51) Int. Cl.
*B65D 43/02* (2006.01)
*B65D 43/16* (2006.01)
*B65D 41/00* (2006.01)

(52) U.S. Cl.
CPC ..... *B65D 43/0216* (2013.01); *B65D 43/16* (2013.01); *B65D 43/162* (2013.01)

(58) Field of Classification Search
USPC ..... 220/839, 562; 215/526, 45
See application file for complete search history.

(56) References Cited

U.S. PATENT DOCUMENTS 3,833,141 A 9/1974 Leitz
3,881,627 A * 5/1975 Davolt ..... B65D 41/0421 215/329
4,393,978 A 7/1983 Kessler et al.
4,655,363 A 4/1987 Neat
7,213,720 B2 5/2007 Giraud
7,537,137 B2 5/2009 Giraud
D599,032 S 8/2009 Bucholtz et al.
D631,168 S 1/2011 Bucholtz et al.
D644,336 S 8/2011 Belfance et al.
D644,337 S 8/2011 Belfance et al.
D644,739 S 9/2011 Belfance et al.
D644,740 S 9/2011 Belfance et al.
D649,659 S 11/2011 Belfance et al.
8,322,530 B2 * 12/2012 Furlong ..... B65D 21/022 206/508
2008/0035658 A1 * 2/2008 Caulfield ..... B65D 43/162 220/839
2011/0127269 A1 6/2011 Bucholtz et al.
2012/0043328 A1 * 2/2012 Pirner ..... B01L 3/50825 220/324

* cited by examiner

PACKAGING SEALING SYSTEM AND A PACKAGING ASSEMBLY INCLUDING SUCH A SEALING SYSTEM

CROSS-REFERENCE TO RELATED APPLICATIONS

This application is a continuation of U.S. patent application Ser. No. 14/761,678 filed Jul. 17, 2015, which is a U.S. National Phase of International Application No. PCT/US2014/012425 filed Jan. 22, 2014, which claims priority to U.S. Provisional Patent Application No. 61/755,555 filed Jan. 23, 2013, which are incorporated herein by reference in their entirety.

FIELD OF INVENTION

The invention is directed to a sealing system for packaging, and in particular to sealing system capable of independently creating a seal or acting in conjunction with another seal to enhance the sealing property of both seals, in such packaging.

SUMMARY

The present invention relates to a packaging assembly including a container body defining an interior for housing a product and an opening leading to the interior. The assembly further includes a cap that moves with respect to the container body to move the assembly between a closed position in which the cap covers the opening, and an opened position in which the opening is exposed. A first seal is defined between the container body and the cap. The first seal includes a protrusion formed on one of the container body about the opening or the cap, and a groove formed on the other of the container body about the opening or the cap. The protrusion is received by the groove when the assembly is in the closed position, such that contact is maintained in a sealing relationship around the opening between the groove and the protrusion.

The present invention further relates to a first seal having the properties described above.

The present invention further relates to a packaging assembly. The packaging assembly includes a container body having a base, a sidewall extending upwardly from the base, an interior defined by the base and the side wall, and a rim at a top portion of the sidewall. The rim defines an opening leading to the interior. The assembly further includes a cap that moves with respect to the container body to move the assembly between a closed position in which the cap covers the opening, and an opened position in which the opening is exposed. The cap includes a top wall and a skirt extending downwardly therefrom. A second seal is defined between the skirt and the rim. The second seal includes a channel formed on an inner radial side of the skirt, and an annular bead formed at a top portion of the rim. The bead has first and second radially spaced bumps that each contact an upper surface of the channel to form a sealing relationship therebetween.

The present invention further relates to a second seal having the properties described above.

The present invention further relates to a packaging assembly having a first seal and as second seal.

The present invention further relates to a packaging assembly having a first seal having the properties described above, and a second seal having the properties described above.

DETAILED DESCRIPTION OF THE PREFERRED EMBODIMENTS

Figure 1:
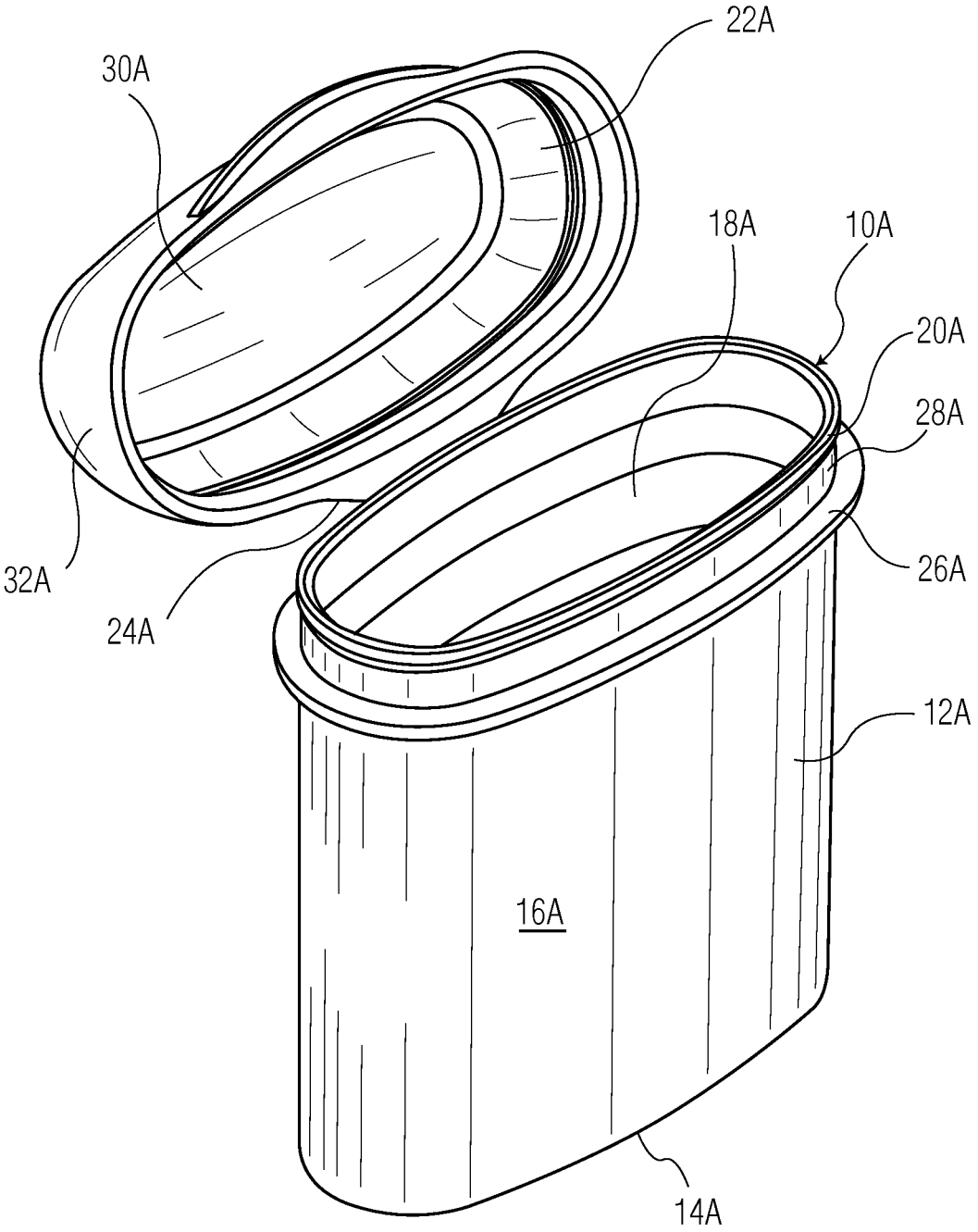
FIG. 1 is a perspective view of a first embodiment of a packaging assembly including a sealing system in accordance with the present invention, in an opened position.
Figure 2:
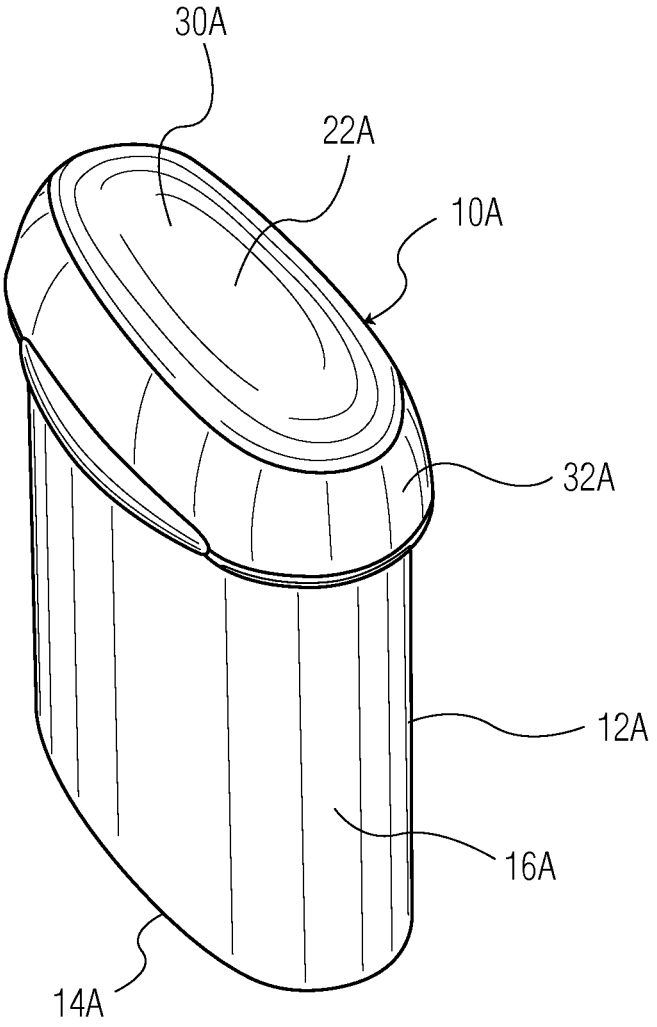
FIG. 2 is a perspective view of the packaging assembly of FIG. 1, in a closed position.
Figure 3:
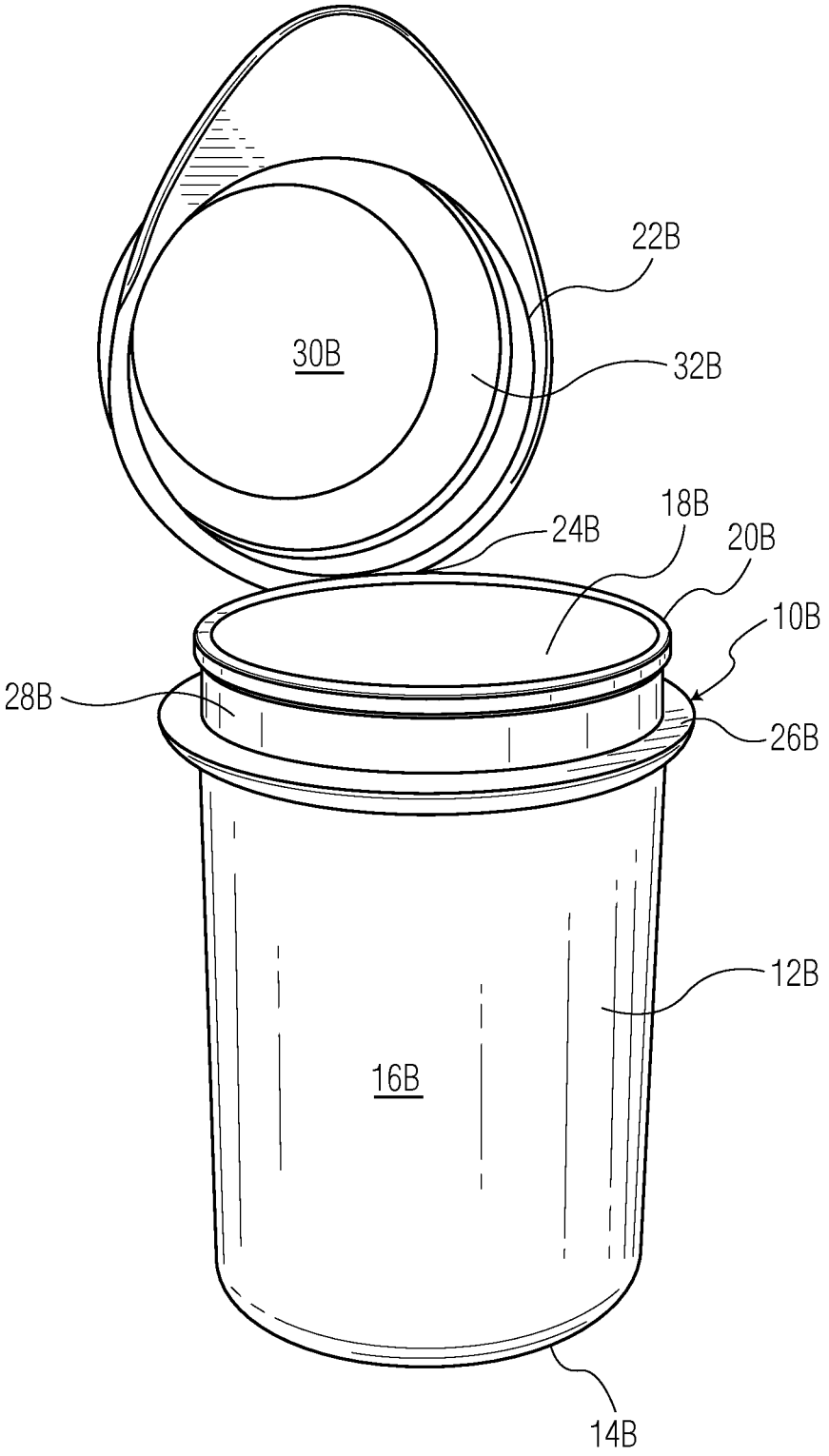
FIG. 3 is a perspective view of a second embodiment of a packaging assembly including a sealing system in accordance with the present invention, in an opened position.
Figure 4:
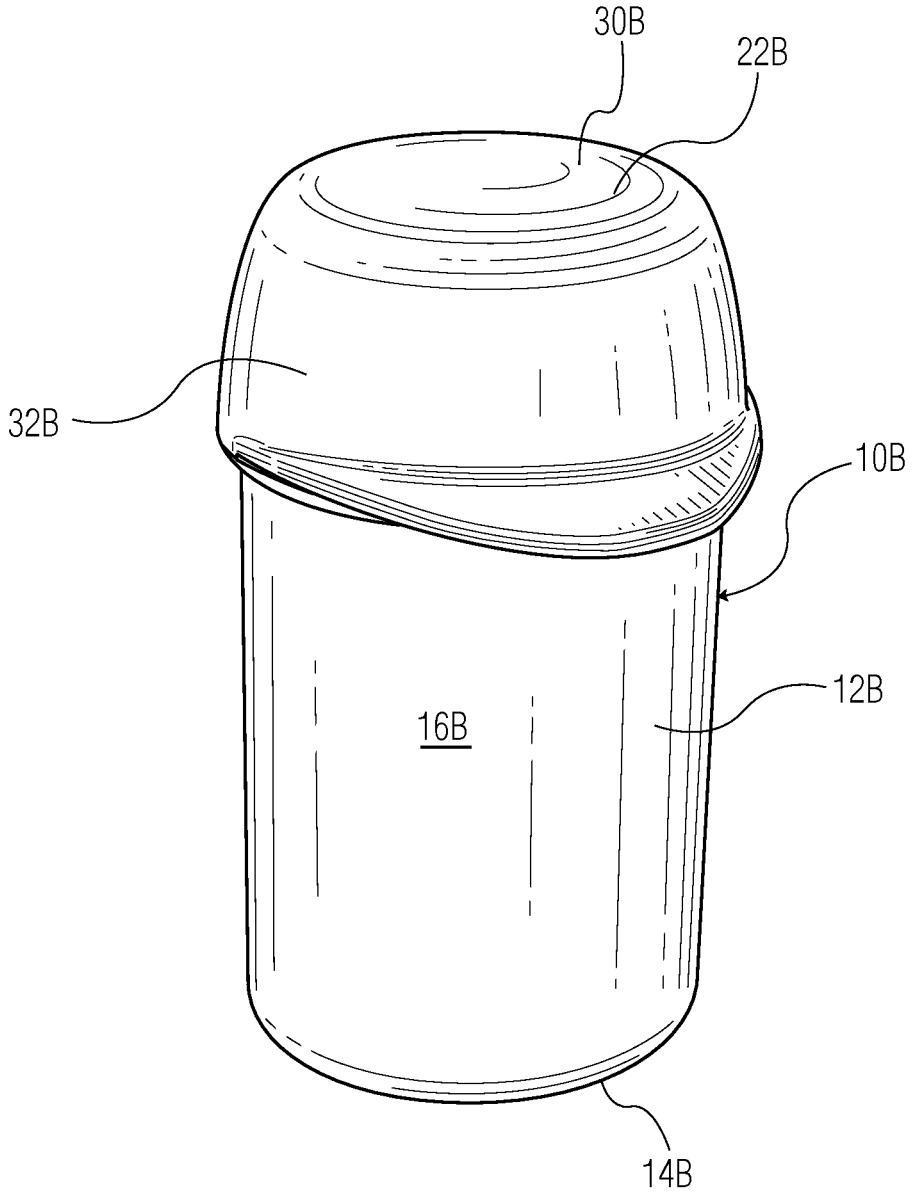
FIG. 4 is a perspective view of the packaging assembly of FIG. 3, in a closed position.
Figure 5:
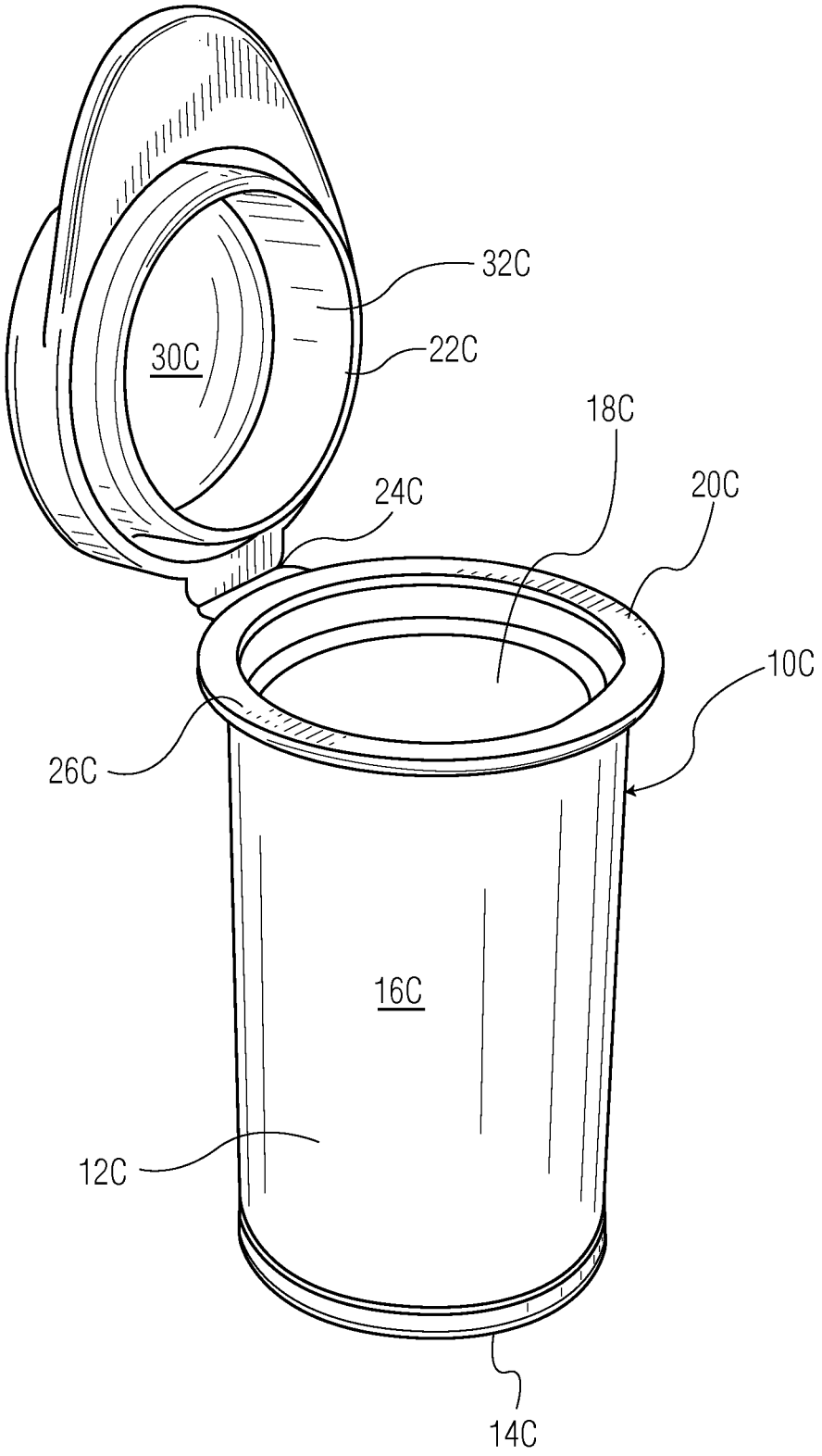
FIG. 5 is a perspective view of a third embodiment of a packaging assembly including a sealing system in accordance with the present invention, in an opened position.
Figure 6:
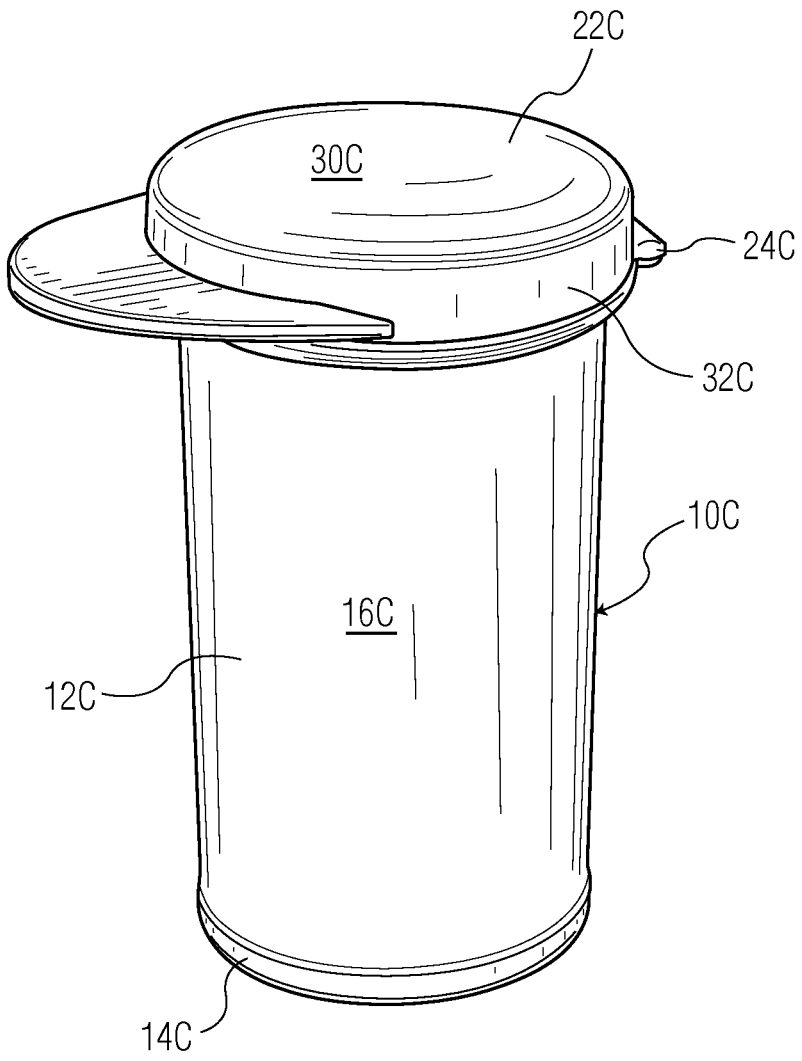
FIG. 6 is a perspective view of the packaging assembly of FIG. 5, in a closed position.
Figure 7:
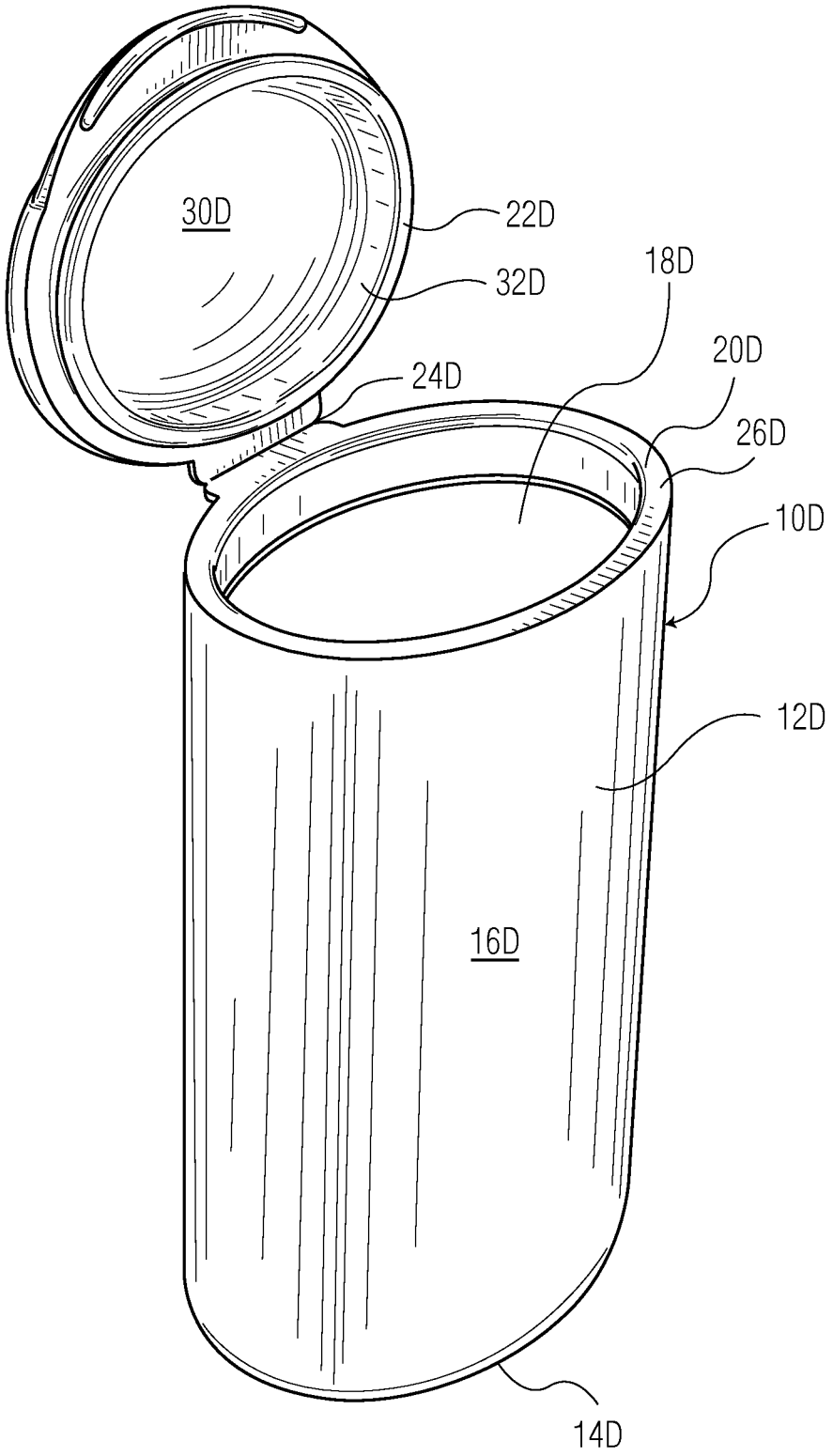
FIG. 7 is a perspective view of a fourth embodiment of a packaging assembly including a sealing system in accordance with the present invention, in an opened position.
Figure 8:
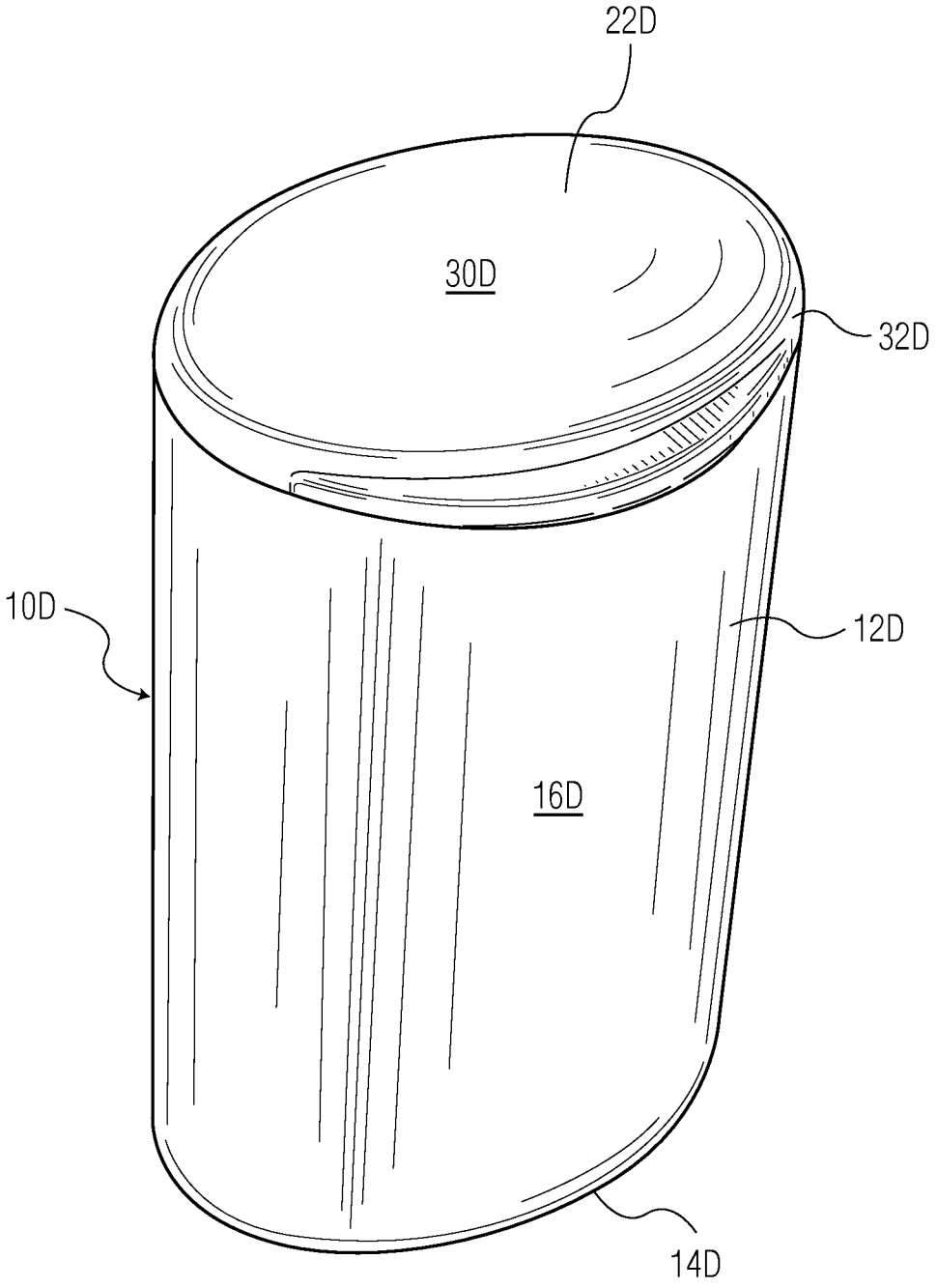
FIG. 8 is a perspective view of the packaging assembly of FIG. 7, in a closed position.
Figure 9:
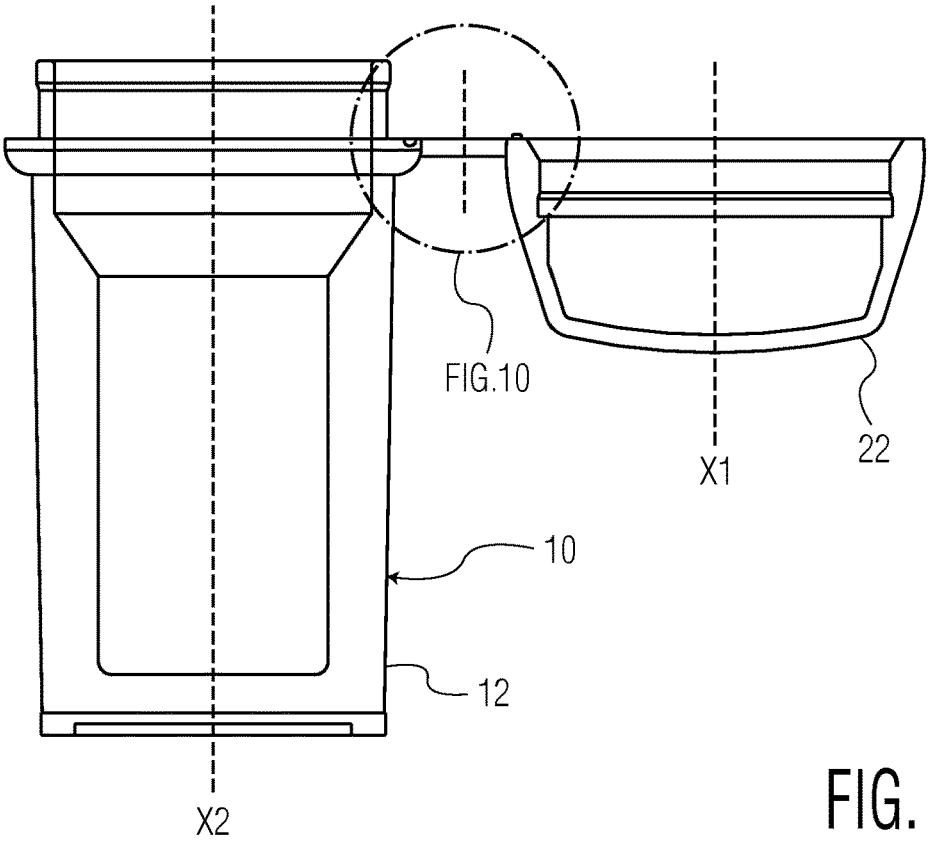
FIG. 9 is a cross sectional view of a packaging assembly including an embodiment of a sealing system in accordance with the present invention, in an opened position.
Figure 10:
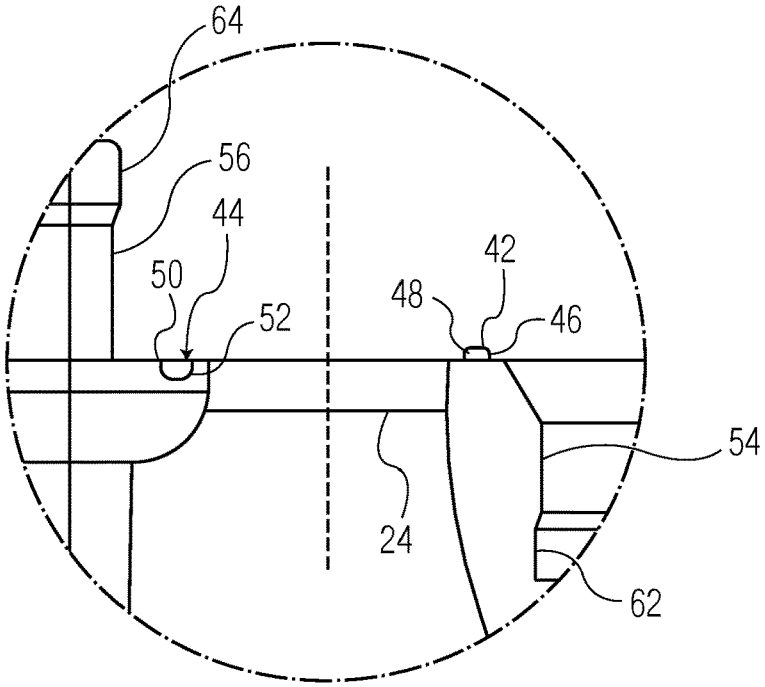
FIG. 10 is an enlarged detail of FIG. 9.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIGS. 1-8 show examples of packaging assemblies 10A-D that could include the sealing system(s) of the present invention. The packaging assemblies 10A-D shown are rigid packaging assemblies, and in particular, vials that can house, for example, pharmaceutical products, confections, other food items, or any other type of products in which a substantially moisture-tight packaging environment is desirable. Each of the assemblies shown includes a container body 12A-12D formed of a base 14A-14D and a sidewall 16A-16D extending upwardly therefrom. The base 14A-D and sidewall 16A-D together define a container interior 18A-D for housing products therein. An opening 20A-D leading to the interior 18A-D is defined about a top edge of the sidewall 16A-D. A cap 22A-D is removably affixed over the opening 20A-D, to move the assembly 10A-D between an opened position, as shown in FIGS. 1, 3, 5 and 7, and a closed position, as shown in FIGS. 2, 4, 6 and 8. The caps 22A-D each include a top wall 30A-D and downwardly extending skirt 32A-D. In the illustrated embodiments, the caps 22 are pivotably affixed to the container bodies 12A-D by hinges 24A-D, such that the caps 22A-D pivot between the opened and closed positions. In each of the illustrated embodiments, the hinges 24A-D extend between bottom edges of the caps 22A-D, and rims 26A-D that extend outwardly from container bodies 12A-D at upper regions thereof. In both of the assemblies show in FIGS. 1-4, a lip 28A, 20B extends upwardly from the rim 26A, 26B. It should be understood that the sealing system(s) of the present invention could be applied to various packaging assemblies, including those shown and described above, as well as those disclosed in US 2011/0127269, D631,168, U.S. D599,032, U.S. D644,336, U.S. D644,739, U.S. D644,740, U.S. D644,337 and D649,659 as well as other types of packaging assemblies, and suitable assemblies would be recognizable to a person of ordinary skill in the art.

Figure 11:
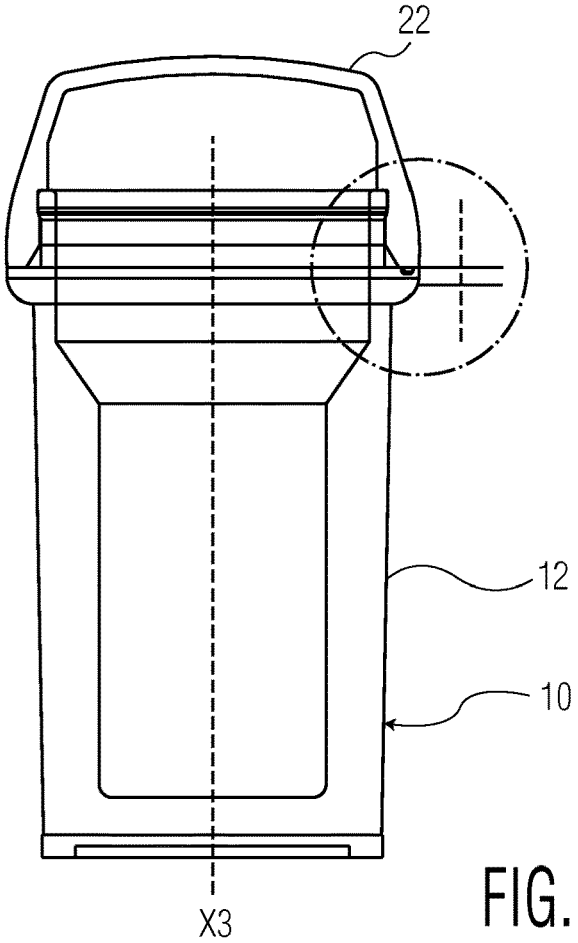
FIG. 11 is a cross sectional view of the packaging assembly of FIG. 9, in a closed position.
Figure 12:
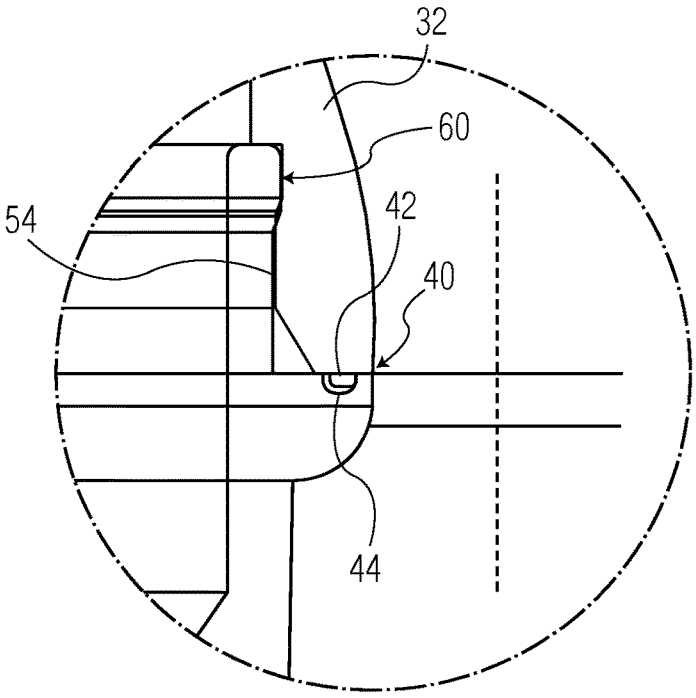
FIG. 12 is an enlarged detail of FIG. 11.

A first embodiment of a sealing system 40 for use with any of the packaging assemblies described above is shown in FIGS. 9-12. As shown, this embodiment of the sealing system 40 includes an annular protrusion 42 that extends downward from a bottom edge of the skirt 32, and an annular groove 44 defined in an upper surface of the rim 26. In another embodiment, a protrusion such as that shown in FIGS. 9-12 could be formed in the upper surface of the rim 26, and an annular groove 44, such as that shown in FIGS. 9-12, could be formed in the bottom edge of the skirt 32. When the container is in the closed position, as shown in FIGS. 11 and 12, the protrusion 42 is housed within the groove 44 to form a seal between the cap 22 and the container body 12. The protrusion 42 may be formed of a rigid material, for example, the same material as that of the remainder of the assembly 10, which could be, for example, a rigid plastic material such as polypropylene. In such an embodiment, the entire assembly 10 could optionally be molded as a single, integral unit.

The protrusion 42 has an inner radial side 46 and an outer radial side 48. Similarly, the groove 44 has an inner radial side 50 and an outer radial side 52. As can be best seen in FIG. 12, the protrusion 42 has a smaller radial thickness than that of the groove 44. As a result, the protrusion 42 and groove 44 make contact and form a seal, only at the inner radial sides 46, 50 or outer radial sides 48, 52 thereof. This helps to compensate for any minor dimensional differences between the cap 22 and the rim 26 of the vial. This also facilitates alignment of the cap 22 and the container body 12 when in the closed position, such that their respective axes X1, X2, align to form a single assembly axis X3, when in the closed position. In the illustrated embodiment, the protrusion 42 and groove 44 contact each other along their outer radial sides 48, 52, though it should be understood that in some embodiments they will contact each other along their inner radial sides 46, 50.

In addition to creating a seal at the area of contact, the configuration shown, in which the protrusion 42 and groove 44 contact along their outer radial sides 48, 52, results in the skirt 32 of the cap 22 being urged radially inward, by way of the radially inward force applied to the protrusion 42 by the radially outer side 42 of groove 44. This helps maintain contact between the inner surface 54 of the skirt 32 and the outer surface 56 of groove 44. This can be helpful in embodiments in which an additional seal 60 is created between the lip 28 and the skirt 32. In the embodiment shown, the assembly includes a first seal 40 or sealing system 40, formed between the protrusion 42 and the groove 44, and a second seal 60 formed between the lip 28 and the skirt 32, with it being understood that the terms "first" and "second" are assigned for distinction and are not necessarily indicative of the order of formation, strength, importance, or significance of the seals. In the illustrated embodiment of FIGS. 9-12, the inner surface of the skirt 54 defines an annular channel 62, and the outer surface 56 of the lip 28 defines an annular bead 64 that engages the annular channel 62, forming the second seal 60 therebetween. Other secondary seal configurations could be used in conjunction with the first seal 40 described above. For example, any of the sealing configurations described in U.S. Pat. No. 7,213,720 or 7,537,137, such as a lip seal configuration, or a sealing configuration such as that described below with reference to FIG. 14 could be employed.

Figure 13:
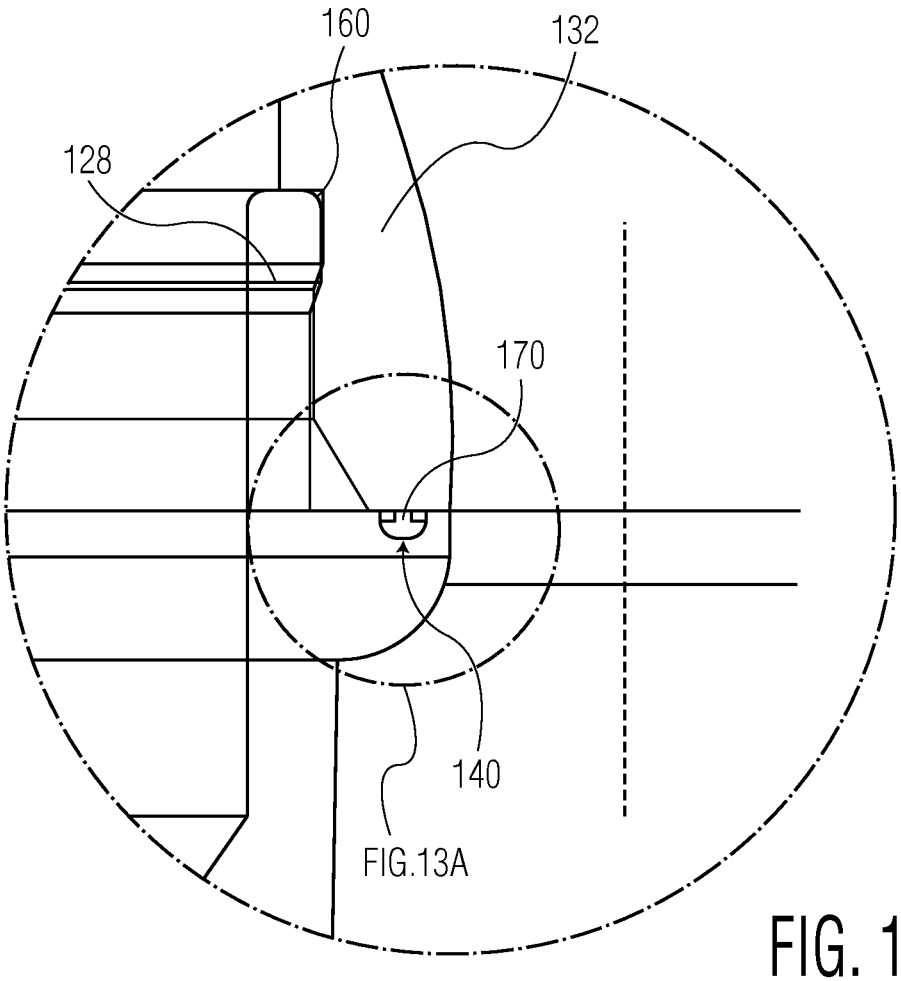
FIG. 13 is a cross section of a portion of a packaging assembly showing a another embodiment of a sealing system in accordance with the present invention.
Figure 13A:
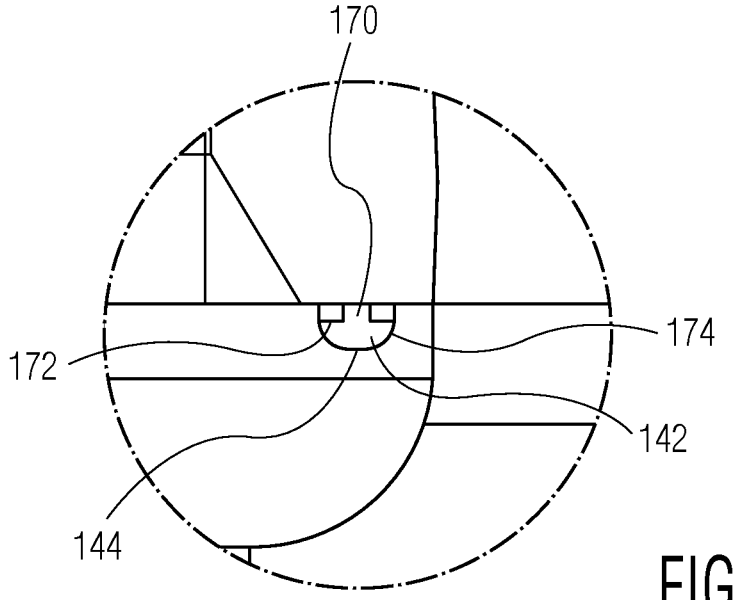
FIG. 13A is an enlarged detail of FIG. 13.

A second embodiment of a first seal 140 according to the invention is shown in FIG. 13. In this embodiment, the protrusion 142 takes on a substantially inverted "T" shape, though the bottom surface may be rounded to match the inner surface of the groove 144. The "T" shape of the protrusion 142 is formed by a single vertical member 170, and inner and outer radial prongs 172, 174. In this embodiment, the protrusion 142 may be formed of a flexible material, such as an elastomeric material, to permit flexing and bending of the prongs 172, 174 during engagement with the groove 144. The flexible material could be different from the material forming the remainder of the assembly, in which case the protrusion 142 could be joined with the skirt 32 by way of adhesive, mechanical fasteners, or formed integrally with the skirt 132 by a two-shot molding process. This embodiment of the first seal 140 functions similarly to that of FIGS. 9-12, with one exception being the fact that, in the embodiment shown, the protrusion 142 and groove 144 engage on both their inner 146, 150 and outer radial sides 148, 152, i.e., both prongs 172, 174 contact the surface of the groove 144, and in particular, may be sufficiently flexible so as to conform to the shape of the groove 144. In another embodiment the protrusion 142 and groove 144 could engage only on their respective inner radial sides 146, 150 or outer radial sides 148, 152, resulting in either the inner radial prong 172 or outer radial prong 174 engaging the groove 144. This embodiment of the first seal can also be employed with any of the second seals mentioned above with respect to the embodiment of FIGS. 9-12.

Figure 14:
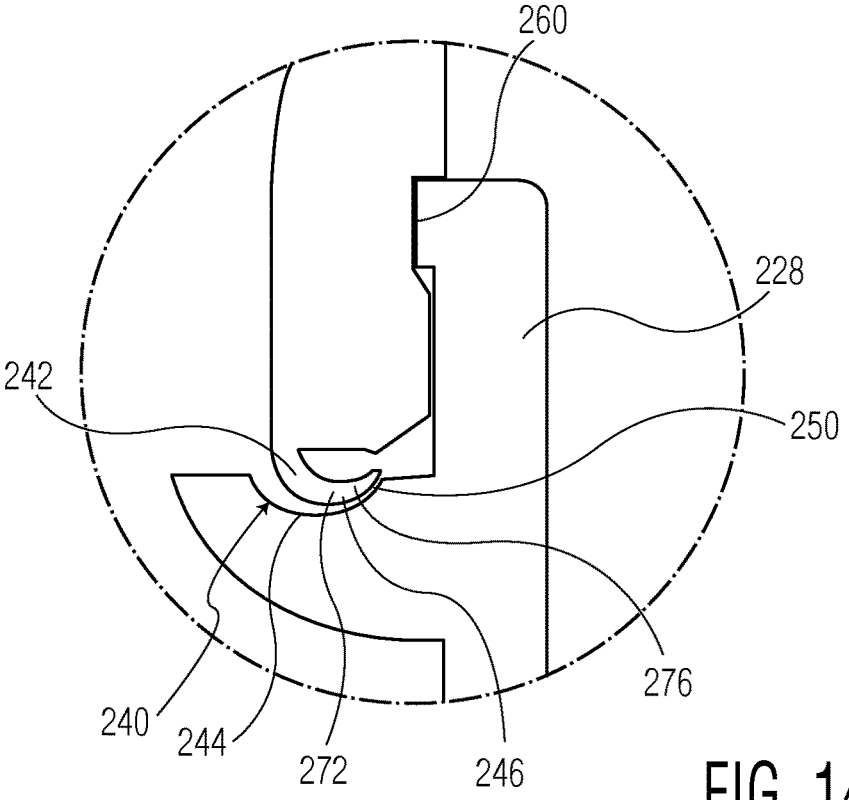
FIG. 14 is a cross section of a portion of a packaging assembly showing another embodiment of a sealing system in accordance with the present invention.

A third embodiment of a first seal 240 according to the invention is shown in FIG. 14. In this embodiment, the protrusion 242 is similar to that of FIG. 13, but includes only a single, radially inwardly extending prong 272. In this embodiment, the protrusion could be formed of a flexible material, such as an elastomeric material, in a similar manner to those described with respect to FIG. 13. In this embodiment, the single prong 272 can engage the radially inner side 250 of groove 244 on the radially inner 246 side of the prong 272, as shown, resulting in the more flexible end portion 276 of the prong 272 contacting the groove 244. Alternatively, the single prong 272 could engage the radially outer side 252 of groove 244 on the radially outer side 248 of the prong 272, resulting in the somewhat less flexible portion thereof contacting the groove 244. This embodiment of the first seal can also be employed with any of the second seals mentioned above with respect to the embodiments of FIGS. 9-13.

Figure 15:
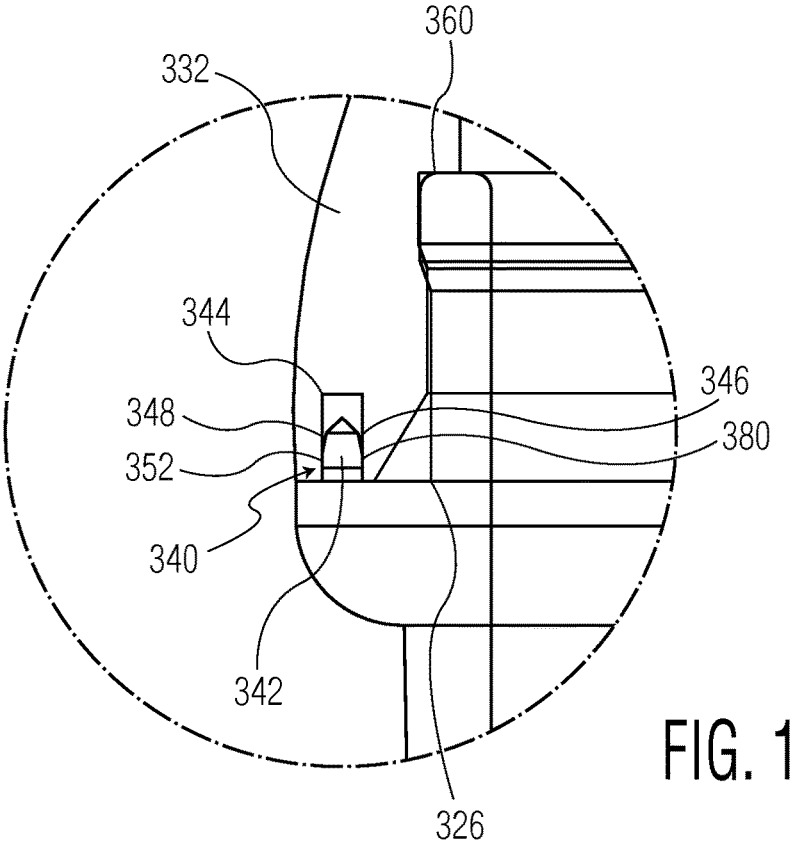
FIG. 15 is a cross section of a portion of a packaging assembly showing another embodiment of a sealing system in accordance with the present invention.

A fourth embodiment of a first seal 340 according to the invention is shown in FIG. 15. This embodiment of the first seal 340 is similar to that of FIGS. 9-12, with the exception of the fact that the protrusion 342 extends from an upper surface of the rim 326, and the groove 344 is defined in a bottom edge of the skirt 332. In this embodiment, the protrusion 342 and groove 344 contact on inner 346, 350 or outer radial sides 348, 352, as described above. Alternatively, the protrusion 342 and the groove 344 could contact on both the inner 346, 350 and outer radial sides 348, 352 thereof. The protrusion 342 and groove 344 in the embodiment shown each have a slightly greater axial length than those of the embodiment of FIGS. 9-12, but it should be understood that the dimensions could be increased or decreased as necessary for these parts to properly engage. The protrusion 342 could be formed of a flexible material, such as an elastomeric material, in a similar manner to those described above with respect to FIGS. 13 and 14. Likewise, the protrusion 342 could be formed of a rigid material, such as the same material of the remainder of the assembly, as described with respect to the embodiment of FIGS. 9-12. This embodiment of the first seal can also be employed with any of the second seals mentioned above with respect to the embodiments of FIGS. 9-14.

Figure 16:
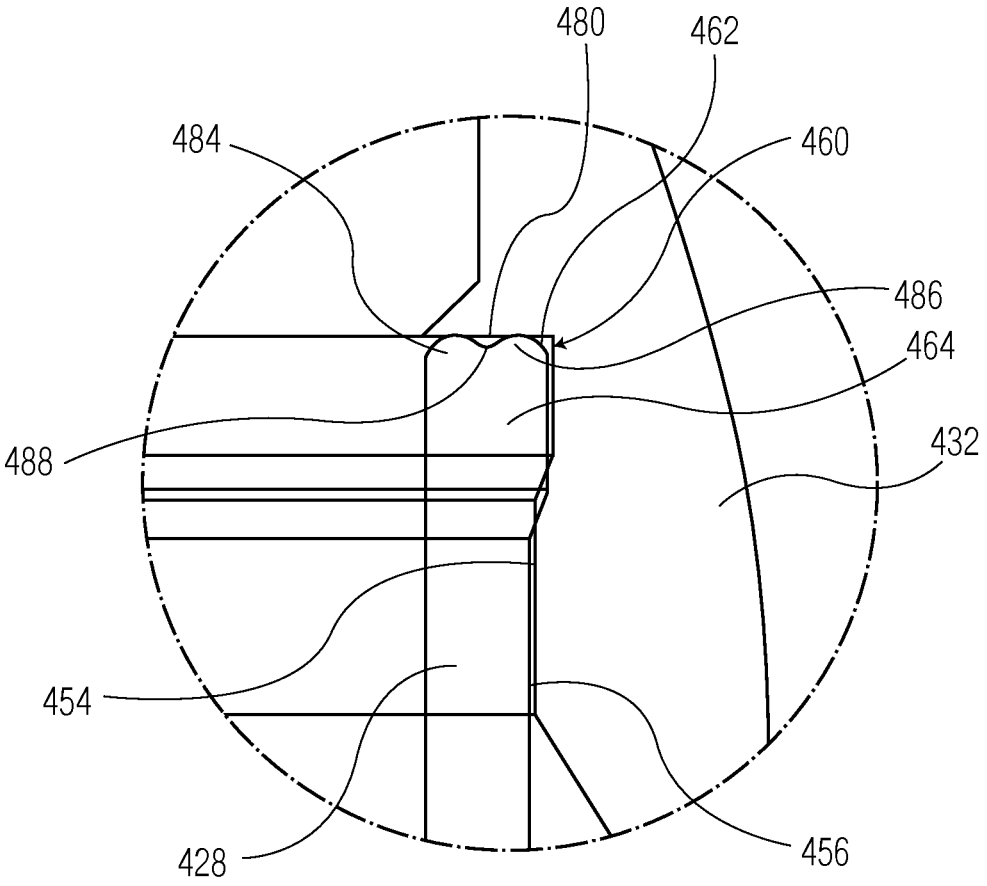
FIG. 16 is a cross section of a portion of a packaging assembly showing another embodiment of a sealing system in accordance with the present invention.

An embodiment of a second seal 460 according to the invention is shown in FIG. 16. In this embodiment, the second seal 460 is formed by engagement of the inner surface 454 of the skirt 432 and the outer surface 456 of the lip 428. The inner surface 454 defines a channel 462, and the outer surface defines a bead 464 that is received by the channel 462, similarly to the second seal 60 described above with respect to FIGS. 9-12. In this embodiment, the channel 462 includes an uppermost, substantially horizontal surface 480 that contacts an upper edge 482 of the bead 464. The bead upper edge 482 includes two radially spaced bumps, including an inner radial bump 484, and an outer radial bump 486. A divot 488 is formed between the two bumps 484, 486. The bumps 484, 486 are equal in axial height. This is preferable in the embodiment shown in which the channel surface 480 is horizontal or perpendicular to the axis X3 of the packaging assembly 410, but in other embodiments the channel surface could be angled or curved and the axial heights of the bumps altered accordingly. As shown, each bump 484, 486 contacts the horizontal surface 480 of the channel 462. This results in two radial sealing regions being defined between the channel 462 and the bead 464. Additionally, the inclusion of two bumps helps to axially orient the cap 422 on the container body 12. This embodiment of the second seal 460 could be employed with any of the first seals described above, as well as with other seals suitable for use as a first seal and known in the art.

Any of the first seals described herein can be combined with any on the second seals described herein, or any other seal suitable for use as a second seal and know in the art. Likewise, any of the second seals described herein can be combined with any of the first seals described herein, or any other seal suitable for use as a first seal and known in the art.

While the preferred embodiments of the invention have been described in detail above, the invention is not limited to the specific embodiments described, which should be considered as merely exemplary.

What is claimed is:

1. A packaging assembly, comprising:

a container body defining an interior for housing a product and an opening leading to the interior, the container body comprising a sidewall, a rim extending radially outwardly from the sidewall, and a lip extending upwardly from the rim;

a cap connected to the container body by a hinge, the cap being movable with respect to the container body to move the assembly between a closed position in which the cap covers the opening, and an opened position in which the opening is exposed, the cap comprising a top wall and a skirt depending downwardly therefrom;

a first seal comprising mating sealing surfaces arranged at the rim of the container body and the cap, the first seal comprising a protrusion formed on the cap, one of the sealing surfaces of the first seal being formed of an elastomeric material and another one of the sealing surfaces of the first seal being formed of a plastic material; and a second seal comprising mating sealing surfaces arranged at the lip of the container body and the skirt of the cap, both sealing surfaces of the second seal being formed of a plastic material, wherein a groove is formed opposite of the protrusion on the rim of the container body about the opening, wherein the protrusion is received by the groove when the assembly is in the closed position, such that contact is maintained in a sealing relationship around the opening between the groove and the protrusion.

2. The packaging assembly according to claim 1, wherein the sealing surface of the first seal formed of the elastomeric material is arranged at the cap and the sealing surface of the first seal formed of the plastic material is arranged at the rim of the container body.

3. The packaging assembly according to claim 1, wherein one of the sealing surfaces of the second seal is arranged at an inner surface of the skirt and the other is arranged at an outer surface of the lip.

4. The packaging assembly according to claim 1, wherein the second seal comprises a channel formed on an inner radial side of the skirt and an annular bead formed at a top portion of the rim.

5. The packaging assembly according to claim 4, wherein the annular bead has first and second radially spaced bumps that each contact an upper surface of the channel to form a sealing relationship therebetween.

6. The packaging assembly according to claim 5, wherein a diameter of the first seal is larger than a diameter of the second seal.

7. A packaging assembly, comprising:

a container body defining an interior for housing a product, an opening leading to the interior, a lip surrounding the opening and extending upwardly from a rim that extends radially outwardly from a sidewall of the container body;

a cap connected to the container body by a hinge, the cap being movable with respect to the container body to move the assembly between a closed position in which the cap covers the opening, and an opened position in which the opening is exposed;

a first seal comprising mating sealing surfaces arranged at the rim of the container body and the cap, the first seal comprising a protrusion formed on one of the rim of the container body about the opening or the cap and a groove formed opposite the protrusion on the other of the rim of the container body about the opening or the cap, the protrusion being received by the groove when the assembly is in the closed position, such that contact is maintained in a sealing relationship around the opening between the groove and the protrusion, one of the sealing surfaces of the first seal being formed of an elastomeric material and another one of the sealing surfaces of the first seal is formed of a plastic material, the sealing surface of the first seal formed of the elastomeric material being arranged at the cap and the sealing surface of the first seal formed of the plastic material being arranged at the rim of the container body; and a second seal comprising mating sealing surfaces arranged at the container body and the cap, wherein both sealing surfaces of the second seal are formed of a plastic material.

8. The packaging assembly according to claim 7, wherein the cap comprises a top wall and a skirt depending downwardly therefrom.

9. The packaging assembly according to claim 8, wherein the mating sealing surfaces of the second seal are arranged at the lip of the container body and the skirt of the cap.

10. The packaging assembly according to claim 9, wherein one of the sealing surfaces of the second seal is arranged at an inner surface of the skirt and the other is arranged at an outer surface of the lip.

11. The packaging assembly according to claim 7, wherein the plastic material of one of the sealing surfaces of the first seal is a rigid material.

12. The packaging assembly according to claim 7, wherein the second seal comprises a channel formed on an inner radial side of the skirt and an annular bead formed at a top portion of the rim.

13. The packaging assembly according to claim 12, wherein an upper surface of the channel is substantially perpendicular to a central axis of the assembly.

14. The packaging assembly according to claim 12, wherein the annular bead has first and second radially spaced bumps that each contact an upper surface of the channel to form a sealing relationship therebetween.

15. A packaging assembly, comprising:

a container body defining an interior for housing a product and an opening leading to the interior, the container body comprising a sidewall, a rim extending radially outwardly from the sidewall, and a lip extending upwardly from the rim;

a cap connected to the container body by a hinge, the cap being movable with respect to the container body to move the assembly between a closed position in which the cap covers the opening, and an opened position in which the opening is exposed, the cap comprising a top wall and a skirt depending downwardly therefrom;

a first seal comprising mating sealing surfaces arranged at the rim of the container body and the cap, the first seal comprising a protrusion formed on the cap, one of the sealing surfaces of the first seal being formed of an elastomeric material and another one of the sealing surfaces of the first seal being formed of a plastic material; and a second seal comprising mating sealing surfaces arranged at the lip of the container body and the skirt of the cap, both sealing surfaces of the second seal being formed of a plastic material, wherein the protrusion extends downward from a bottom edge of the skirt when the cap is in the closed position.

16. The packaging assembly according to claim 15, further comprising an annular groove formed in an upper surface of the rim, the annular groove being configured to receive the protrusion when the cap is in the closed position.

17. The packaging assembly according to claim 7, wherein the protrusion has an inner radial side and an outer radial side, the groove having an inner radial side and an outer radial side, the protrusion having a smaller radial thickness than the groove such that the protrusion and the groove make contact and form a seal only at the inner radial sides or the outer radial sides.

18. A packaging assembly, comprising:

a container body defining an interior for housing a product and an opening leading to the interior, the container body comprising a lip;

a cap connected to the container body by a hinge, the cap being movable with respect to the container body to move the assembly between a closed position in which the cap covers the opening, and an opened position in which the opening is exposed, the cap comprising a top wall and a skirt depending downwardly therefrom;

a first seal comprising mating sealing surfaces arranged at the container body and the cap, the first seal comprising a protrusion formed on one of the container body about the opening or the cap, the protrusion including at least one radially extending prong, one of the sealing surfaces of the first seal being formed of an elastomeric material and another one of the sealing surfaces of the first seal being formed of a plastic material; and a second seal comprising mating sealing surfaces arranged at the lip of the container body and the skirt of the cap, both sealing surfaces of the second seal being formed of a plastic material, wherein the protrusion includes a vertical member, the at least one radially extending prong includes two radially extending prongs extending in opposing directions from the vertical member.

* * * * *